United States Patent [19]

Cowdery et al.

[11] 4,106,151

[45] Aug. 15, 1978

[54] CARPET SWEEPER

[75] Inventors: Ray Cowdery, Burnsville; Johan M. Larsen, Edina, both of Minn.

[73] Assignee: Hukuba Kogyo Kabushiki Kaisha, Japan

[21] Appl. No.: 767,632

[22] Filed: Feb. 10, 1977

[30] Foreign Application Priority Data

Oct. 25, 1976 [JP] Japan ..... 51-143311[U]

[51] Int. Cl.[2] ..... A47L 11/32

[52] U.S. Cl. ..... 15/42; 15/145; 51/205 R

[58] Field of Search ..... 15/41–48, 15/49 R, 49 C, 50 R, 50 C, 79 R, 79 A, 98, 143, 145; 51/205 R; 7/1 L, 1 N, 15; 56/7

[56] References Cited

U.S. PATENT DOCUMENTS

| | | | |
|---|---|---|---|
| 1,582,947 | 5/1926 | Wagner et al. | 56/7 X |
| 2,951,673 | 11/1960 | Rench et al. | 15/49 C X |
| 3,800,351 | 4/1974 | Fukuba | 15/41 R |

FOREIGN PATENT DOCUMENTS

| | | | |
|---|---|---|---|
| 699,971 | 11/1953 | United Kingdom | 56/7 |

*Primary Examiner*—Edward L. Roberts
*Attorney, Agent, or Firm*—Wenderoth, Lind & Ponack

[57] ABSTRACT

An improved carpet sweeper includes a handle, an intermediate member having legs at the lower portion thereof, and a plurality of sweeper units, the number of legs being equal to that of the sweeper units. Each of the corresponding legs and sweeper units is connected to provide the assembly of the sweeper units.

5 Claims, 6 Drawing Figures

CARPET SWEEPER

BACKGROUND OF THE INVENTION

This invention relates to a carpet sweeper and more particularly to a carpet sweeper which is composed of a plurality of sweeper units.

In the past, there has been known a carpet sweeper which mainly comprises a handle for handling the carpet sweeper, a frame cover with dust receptacles pivotally connected with the lower end of the handle, a rotary brush positioned between the dust receptacles, rolling wheels to be forcedly rotated by contact with the floor, and a driven wheel for conveying the rotation of the rolling wheels to the rotary brush as disclosed, for example, in the U.S. Pat. Nos. 3,268,936 and 3,754,294. Such a carpet sweeper can remove dust and dirt from the floor by being moved manually forwards and backwards thereon.

According to the carpet sweeper set forth above, however, it is difficult to enlarge the width thereof more than a limited dimension because the handling operation becomes worse as it exceeds, for instance, 30 - 40 centimeters. Therefore, the number of forward and backward movements is inevitably increased to sweep a relatively wide floor by the prior art carpet sweeper. Further, as a carpet sweeper becomes wider, the more difficult it is to find a space in a house to stow it away.

Accordingly, it is an object of the present invention to provide a carpet sweeper which as a wider sweeping width so that the number of forward and backward sweeping operations is extremely decreased. It is another object of the present invention to provide a carpet sweeper which can be disassembled into a plurality of sweeper units so that a space to stow them away can be easily found in a house.

BRIEF DESCRIPTION OF THE INVENTION

According to the present invention, a carpet sweeper comprises a handle for handling the carpet sweeper, an intermediate member having at least two legs at the lower portion thereof and a plurality of sweeper units equal in number to the legs of the member, each of the sweeper units comprising a frame cover, a pair of dust receptacles positioned at the inner sides of the frame cover and a rotary brush provided between the pair of dust receptacles.

According to one feature of the present invention, each of the sweeper units may be coupled to the intermediate member by the connection between the corresponding legs thereof and fitting rods each pivoted to a supporting shaft in a groove of the respective frame cover.

Accordingly, the provision of the intermediate member allows the assembly of a desired number of sweeping units to thereby provide a carpet sweeper having a predetermined width. Further, in spite of the increased width thereof, the carpet sweeper is easily handled during operation due to the structure that rotary brushes are independently suspended in each of the sweeper units, so that the carpet sweeper can be handled even on a transversely waved carpet .

BRIEF DESCRIPTION OF THE DRAWING

These and other features of the present invention will be clearly understood when considered with reference to the accompanying drawings wherein.

DETAILED DESCRIPTION OF THE INVENTION

The present invention will now be explained with reference to embodiments illustrated in the accompanying drawings.

Figure 1:
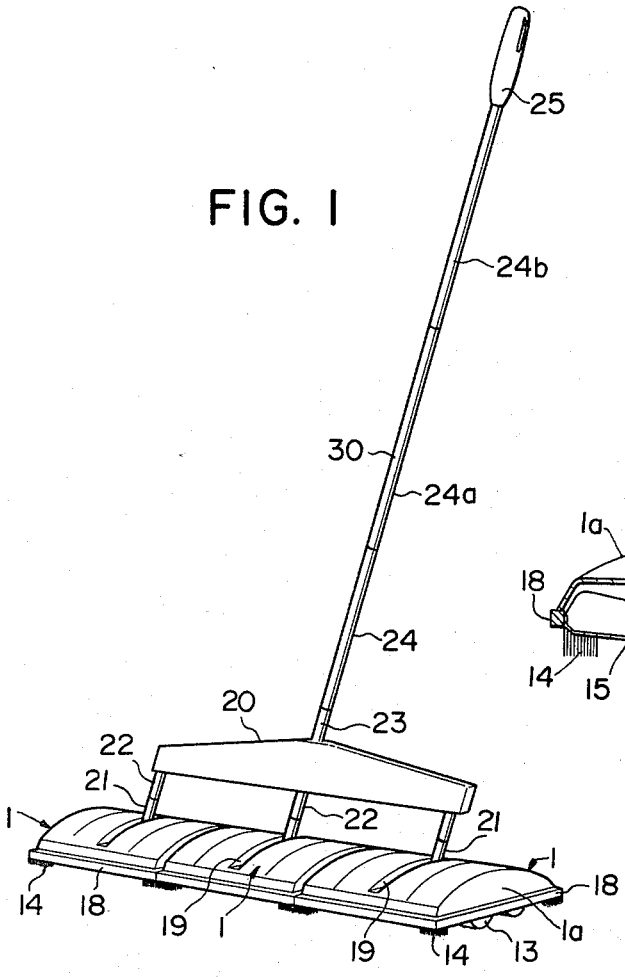
FIG. 1 is a perspective view illustrating a carpet sweeper according to the present invention.

Referring now to FIG. 1, there is shown a carpet sweeper comprising three sweeper unit 1, an intermediate member 20 having three legs 22 at the lower portion thereof and a single hand or arm 23 at the upper portion thereof, and a handle 30 composed of three elements 24, **24*a* and 24*b* and having a grip 25 at the top thereof. Each of the sweeper units 1 comprises a frame cover 1*a* having an arcuate top plate with a groove 19 and a cushion material 18 surrounding outer sides thereof. The frame cover 1*a* may be made of a thin sheet of a suitable metal or plastic material and the cushion material 18 may be of a synthetic rubber or foamed plastic. The sweeper unit 1 is also provided with brushes 14 at each corner thereof and rolling wheels 13** partially exposed therefrom.

Figure 2:
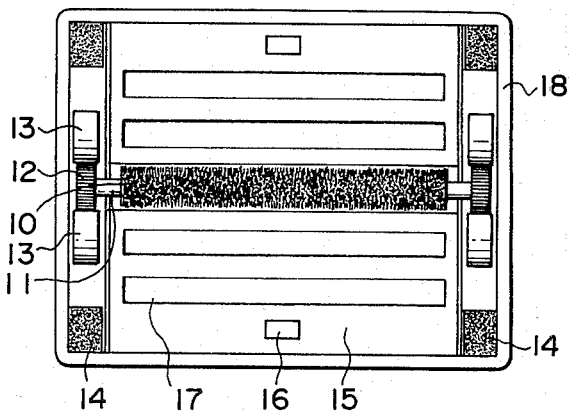
FIG. 2 is a bottom plan view illustrating a sweeper unit for a carpet sweeper according to the present invention.

Referring next to FIG. 2, there is shown in more detail the arrangement of the sweeper unit 1 illustrated in FIG. 1. The sweeper unit comprises a rotary brush 10 positioned at the center thereof, a driven roller 12 connected with the rotary brush 10 by means of a common shaft 11, rolling wheels 13 in friction engagement with the driven roller 12, four brushes 14 at each corner thereof, a pair of dust receptacles 15, and a cushion material 18 therearound. The dust receptacle may have corrugated portions 17 to reinforce the mechanical strength thereof and a hollow portion 16 which may be opened by the thumb of an operator.

Figure 3:
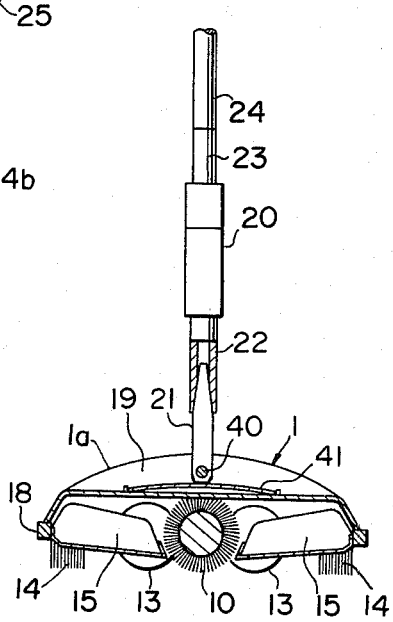
FIG. 3 is a partially sectional view illustrating the coupling between an intermediate member and a sweeper unit.

In FIG. 3, there is an illustration of the coupling of a sweeper unit 1 with an intermediate member 20 by the connection between one of legs 22 of the intermediate member and a fitting rod 21. The sweeper unit 1, as previously mentioned, comprises a frame cover **1*a*, a rotary brush 10, rolling wheels 13, brushes 14, dust receptacles 15 and a cushion material 18. An elongated groove 19 is provided on the top surface of the frame cover 1*a* to accomodate a fitting rod 21 therein. A leaf spring 41 may be loaded in the groove 19 so as to apply a predetermined pressure to the bottom end of the fitting rod 21 which is pivotally fixed to a supporting shaft 40. In more detail, the bottom end of the fitting rod 21 is shaped to be flat such that it make contact with the top surface of the leaf spring 41. This allows the fitting rod 21, and therefore the handle 30 as shown in FIG. 1, to be self-support at a desired angle to the upright. A single hand or arm 23 of the intermediate member 20 is connected with an element 24 of the handle in the same manner as described with reference to FIG. 1**.

Figure 4A:
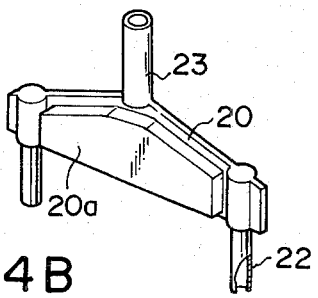
FIG. 4A and 4B are perspective views respectively illustrating two kinds of intermediate members.
Figure 4B:
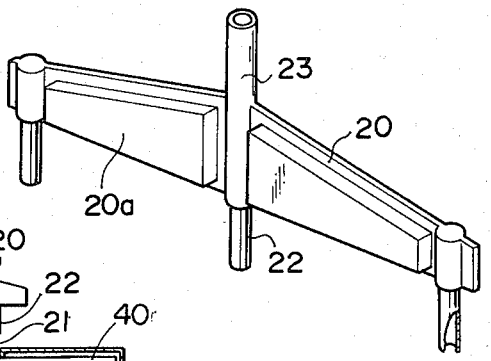

With reference to FIGS. 4A and 4B, there are shown two types of intermediate members for the assembly of a plurality of sweeper units. In FIG. 4A, the intermediate member 20 includes two legs 22 and a single hand 23. Accordingly, a carpet sweeper is assembled with two sweeper units, by use of this type of intermediate member. In FIG. 4B, on the other hand, the intermediate member 20 includes three legs 22 and a single hand 23 and this construction allows the assembly of three sweeper units. In both instances, each of legs 22 may be of a pipe shape so that the respective rod 21 can be inserted thereinto. One or more convex or thickened portions 20*a* may also be provided on the main body of the intermediate member 20 to reinforce the mechanical strength thereof.

Figure 5:
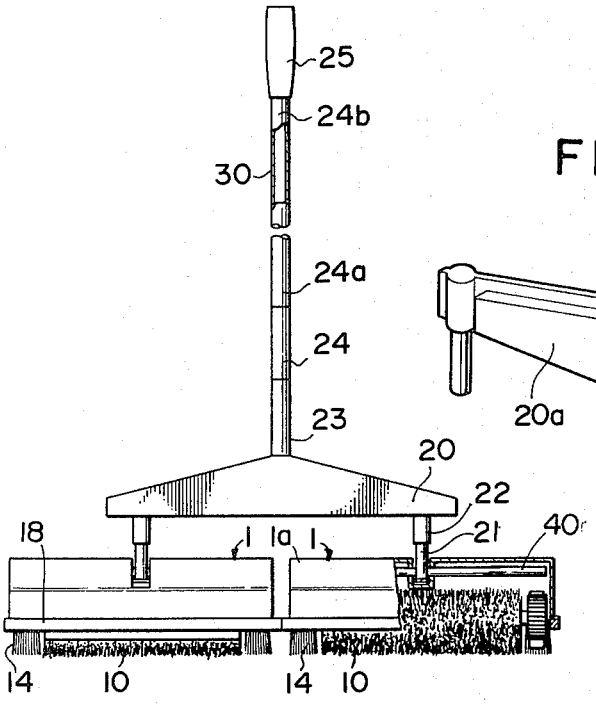
FIG. 5 is a partially cut away view illustrating a carpet sweeper according to the present invention.

Referring to FIG. 5, there is shown a carpet sweeper which comprises two sweeper units 1, an intermediate member 20 and a handle 30. The sweeper unit 1 comprises a frame cover 1*a*, a rotary brush 10, brushes 14 provided at each corner thereof, a cushion material 18, a supporting shaft 40 and a fitting rod 21 pivoted thereto. The intermediate member 20 has a single hand 23 and two legs 22 each coupled to a corresponding sweeper unit 1 by the connection between the leg 22 and the fitting rod 21. The handle 30 is composed of three elements 24, 24*a* and 24*b* and a grip 25.

As clearly seen in FIGS. 1 and 5, the sweeper units 1 may be assembled in such a manner that the cushion materials 18 are in a surface to surface contact to result in a significant friction engagement therebetween. This allows the sweeper units 1 connected to the intermediate member 20 to move forward and backward by the manual operation of the handle 30 while the sweeper units 1 are prevented from being vibrated under the corresponding legs 22. Thus, a carpet may be swept across a width determined in accordance with the number of the sweeper units 1.

In operation, a carpet sweeper according to the present invention is moved forward and backward manually. This causes a pair of rolling wheels 13 to forcedly rotate by contact thereof with the floor to be swept. The rotation of the rolling wheels 13 is conveyed to a driven roller 13 by a friction engagement therebetween so that a rotary brush 10 is driven to rotate in a predetermined direction and speed. Accordingly, dust and dirt on the floor can be efficiently swept off into dust receptacles 15.

Although the present invention has been described with reference to the preferred embodiments thereof, many modifications and alterations may be made within the spirit of the present invention.

What is claimed is:

1. A carpet sweeper comprising:

a plurality of sweeper units, each said sweeper unit comprising a frame cover having an arcuate top plate with a groove therein, a fitting rod resiliently supported to extend outwardly through said groove, cushion material surrounding and extending outwardly from the outer sides of said frame cover, a pair of dust receptacles, a rotary brush supported between said dust receptacles, driven roller means integral with said brush, and rolling wheels supported to be in contact with said driven roller means, such that as said sweeper unit is moved over a floor surface, said rolling wheels roll by contact with the floor surface and thereby drive said driven roller means and said rotary brush;

an intermediate member comprising a main body, a single arm extending outwardly from said main body in a first direction, a plurality, equal to the number of said sweeping units, of legs extending outwardly from said main body in a second direction, and said main body having thickened convex portions mechanically reinforcing said main body;

a handle comprising a plurality of elements adapted to be connected together to form an elongated handle having first and second ends, and a grip attached to said first end of said handle; and said plurality of sweeper units, said intermediate member, and said handle being removably assembled in a manner such that said plurality of sweeper units are aligned in side-by-side relationship with said cushion material of adjacent sweeping units in friction contact, each of said fitting rods are connected to a respective said leg of said intermediate member, and said arm is connected to said second end of said elongated handle.

2. A carpet sweeper as claimed in claim 1, wherein said legs are hollow, and said fitting rods extend into said hollow legs.

3. A carpet sweeper as claimed in claim 1, wherein said second end of said elongated handle is hollow, and said arm extends into said hollow second end.

4. A carpet sweeper as claimed in claim 1, wherein each said fitting rod is pivotally fixed to a supporting shaft of the respective sweeper unit.

5. A carpet sweeper as claimed in claim 1, wherein each said fitting rod is urged in a direction outwardly of the respective groove by means of a leaf spring provided in said groove.

* * * * *